US005974619A

United States Patent [19]

Weihrauch

[11] Patent Number: 5,974,619

[45] Date of Patent: Nov. 2, 1999

[54] BRUSHES

[75] Inventor: Georg Weihrauch, Wald-Michelbach, Germany

[73] Assignee: Coronet-Werke GmbH, Wald-Michelbach, Germany

[21] Appl. No.: 08/894,380

[22] PCT Filed: Feb. 29, 1996

[86] PCT No.: PCT/EP96/00822

§ 371 Date: Aug. 18, 1997

§ 102(e) Date: Aug. 18, 1997

[87] PCT Pub. No.: WO96/27308

PCT Pub. Date: Sep. 12, 1996

[30] Foreign Application Priority Data

Mar. 3, 1995 [DE] Germany ..... 195 07 364

[51] Int. Cl.[6] ..... A46B 3/02; A46B 9/04

[52] U.S. Cl. ..... 15/186; 15/207.2; 15/DIG. 5

[58] Field of Search ..... 15/167.1, 186, 15/187, 193, 207.2, DIG. 5

[56] References Cited

U.S. PATENT DOCUMENTS

| | | | |
|---|---|---|---|
| 2,317,485 | 4/1943 | Rider | 15/207.2 |
| 2,426,328 | 8/1947 | Wandel | 15/207.2 |
| 2,441,682 | 5/1948 | Wybrants | 15/186 |
| 2,482,928 | 9/1949 | Neff | 15/186 |
| 3,325,845 | 6/1967 | Sawkiw | 15/207.2 |
| 4,114,222 | 9/1978 | Serediuk | 15/186 |
| 4,161,050 | 7/1979 | Sasaki | 15/DIG. 5 |
| 4,373,541 | 2/1983 | Nishioka | 15/207.2 |
| 4,610,045 | 9/1986 | Rauch | 15/DIG. 5 |
| 4,766,633 | 8/1988 | Clark | 15/DIG. 5 |
| 4,804,004 | 2/1989 | Taylor | 15/207.2 |
| 4,958,402 | 9/1990 | Weihrauch | 15/186 |
| 5,249,327 | 10/1993 | Hing | 15/DIG. 5 |
| 5,398,367 | 3/1995 | Lu | 15/DIG. 5 |
| 5,446,940 | 9/1995 | Curtis | 15/DIG. 5 |
| 5,604,951 | 2/1997 | Shipp | 15/DIG. 5 |

*Primary Examiner*—Randall E. Chin

*Attorney, Agent, or Firm*—Antonelli, Terry, Stout & Kraus, LLP

[57] ABSTRACT

Brushes, e.g. a brush, particularly a hygienic brush, or a paintbrush, which is exposed to moisture during use and which has a bristle carrier, preferably made from plastic, and a bristle facing. The entire bristle facing is formed from individual, closely standing, non-contacting bristles.

16 Claims, 2 Drawing Sheets

BRUSHES

BACKGROUND OF THE INVENTION

The invention relates to brushware, e.g. a brush, paintbrush, etc., which is exposed to moisture during use and which has a bristle carrier and a bristle facing at least partly comprising individual, standing plastic bristles.

Brushware which is exposed to moisture, either through use in a moist atmosphere for cleaning purposes, e.g. toothbrushes, or for the application of wet media, e.g. paintbrushes, only dry incompletely after use because the bristles are combined into bundles, and the moisture is retained for a long time in the narrow capillaries between the bristles. This moist atmosphere forms ideal conditions for the settling or deposition and growth of bacteria and microbes. This disadvantageous effect is assisted by dirt particles or residue of the application media which are deposited in the narrow capillaries, and which can only be inadequately removed, even after intense cleaning efforts, because the bristles in the root area are too close together. These negative effects are exacerbated by the fact that in many brush constructions the bristle carrier is provided with recesses in which the bristle bundles are inserted. In these very small cross-section cavities the bacteria are deposited particularly easily, in the same way as dirt particles and the residues of application media which cannot be removed therefrom.

These disadvantageous effects are noted to a particular extent in toothbrushes, because in this case the aim is to insert bristles with the smallest possible diameters tightly within the bundle, and so that the capillaries and cavities are particularly narrow. Moreover, despite the use of high-grade plastics for the bristles, e.g. polyamides, moisture penetrates the bristle material, and on drying the moisture is not, or is only inadequately, given off. This leads to a change in the strength characteristics of the bristles. The bristles lose stiffness and therefore their recovery capacity, so that their cleaning action no longer corresponds to the original state.

The aforementioned disadvantages occur more particularly in the case of toothbrushes when the dentally recommended cleaning intervals of three times a day is followed, because the intermediate time is insufficient to permit a complete drying of the bristles, particularly in the area close to the carrier.

As a result of these hygienic problems, in the past joining methods from plastic technology were used in fixing the bristles to the bristle carrier, so as to in particular avoid cavities on said carrier in the vicinity of the bristle facing. These in particular include the welding of bristles and bristle carrier (EP 165 546) and the injection moulding of the bristles into the carrier (DE 1 532 809). In conjunction with the welding process (EP 165 546) it has already been proposed not to form the bristle facing from bundles, but also to provide individual, standing or upright bristles in a dense arrangement. The aim is in particular to make the bristle facing such that account is taken of the zonally differing, pronounced wear. This also permits an adaptation of the different areas of the bristle facing to different use functions (cleaning, massage, etc.).

These different use functions are also taken into account in another known construction (GB 2 035 076), in which in the median longitudinal area of the bristle carrier bristle bundles are provided, whereas on either side of said area there are rows of plastic pins having different configurations, the brush head also being curved in the direction of both axes. Therefore the bristles only act on the tooth parts, whereas the relatively soft plastic pins mainly exert a massaging action on the gingiva. Quite apart from the complicated manufacture of such a toothbrush, in the area of the bristle facing is the hygienic problem solved, and the toothbrush does not satisfy modern dental findings for effective cleaning of the teeth and not adequate massaging of the gums in that the brush cannot be guided from the gums to the teeth (red to white).

The aforementioned hygienic problems are supposedly removed in another known construction (EP 60 592), in that the bristle facing comprises, instead of bundles, individual bristles, which are connected to the carrier and also to one another by thermal processes, particularly by laser technology. The bristles are free at their carrier-side end, in that the bristle carrier has a large recess corresponding to the bristle facing contour and the bristles are inserted in said recess in such a way that they are exposed on the back of the carrier. The bristles are only interconnected in the vicinity of said recess and only in the area of their tangent lateral surfaces. This is intended to ensure that through capillaries remain between the bristles, which allegedly make it possible to suck off bacteria and plaque residues. How this takes place and which physical forces are to be used are not disclosed in this document. However, what is decisive is that the bristles must engage on one another at the lateral surfaces, so as to be interconnectable at said surfaces. However, this ultimately means that the same narrow bristle pack exists as in a bundle, because also there the bristles only engage linearly on one another at the lateral surfaces. Thus, the same capillaries form as in the case of a bristle bundle. In addition, it is possible for bacteria to be deposited and grow not just on one side, but on both sides of the bristle carrier.

SUMMARY OF THE INVENTION

The problem of the invention is to so further develop brushware, whose bristle facing at least partly comprises individual, standing bristles, that a rapid drying of the brush is ensured, and in this way there is a successful limitation to the settling and growth of bacteria and the incorporation of impurities and contaminants, whilst giving a free design possibility for the bristle geometry, which makes it possible to achieve different use characteristics.

According to the invention this problem is solved in that the entire bristle facing consists of individual, closely standing, non-contacting bristles.

Modern plastic technology allows a transitionless fastening of small diameter, individual bristles to a planar surface, namely that of the bristle carrier. This can take place by welding on or in, or also by injection moulding. Bonding is also possible. Unlike in the case of bundles, with individual bristles the formation of recesses, depressions, etc. can be avoided, whilst in the case of bundles, due to the larger mass to be melted and/or the uncontrolled cooling due to said larger masses, it is scarcely possible to obtain a smooth carrier surface. In addition, with bundles, an adequate pull-out resistance is only ensured if all the bristles of a bundle are melted on the fastening-side end and are interconnected, so that a thickening forms which, due to its corresponding mass, leads to the aforementioned, negative effects. These disadvantages do not occur with individual bristles in the vicinity of their fastening. Moreover, the individual bristles can be arranged with such a mutual spacing that between said bristles bacteria cannot settle and propagate and also there can be no deposition of dirt (plaque, treatment or application media residues). The gaps can be washed out without any problem.

A brush constructed in this way dries in a short time, so that the aforementioned dangers are effectively counteracted. In addition, the bristle itself does not absorb any, or at the most very little liquid, and the liquid is gone on drying, so that after use the bristle recovers in a short time its original strength characteristics. Due to the limited spacing of the bristles, channels form which are used for receiving and retaining liquid to pasty application media, e.g. dyes, paints, mascara, or cleaning and polishing agents such as toothpastes, gels, polishing pastes, etc.

The use characteristics are exclusively determined by the geometry of the bristles (diameter and length) and their material (polyamide, polyester, etc.), as well as by the geometry of the arrangement (more or less dense, but always with a spacing).

The use characteristics and the obtaining of certain cleaning and/or massaging actions can also be brought about in that the individual bristles or bristle bundles have different lengths, and their free ends are located on a curved or stepped envelope surface.

Through this construction it is ensured that e.g. in the case of toothbrushes, individual, longer bristles effectively penetrate e.g. interdental gaps, whereas the shorter bristles act on the tooth surfaces. The varyingly long bristles lead, during the cleaning movement, to different springing out and back of the bristles when sliding over the tooth surfaces, whereas the shorter bristles tend to act with their ends. This leads to a more or less pronounced scraping or spreading effect. This can also be assisted by different spacings of the bristles within the bristle facing, so that there is a different springing out and back of the bristles. The stiffness of the overall bristle facing can be varied not only by the dimensioning of the bristle (diameter, length) and the material, but in particular through the spacing of the bristles, and this can take place with very fine differences.

The bristles can also be combined into groups and the spacing of the bristles of a group can be the same, but different from that of another group. Thus, e.g. in the case of a toothbrush, the head or marginal area can have a greater bristle density than the central area.

As has already been indicated, the bristles can also have different stiffnesses, e.g. different diameters, whilst here again it is possible to provide bristle groups having different stiffnesses, but identical within the same group.

It is known per se to provide monofilaments for bristles with structured surfaces, abrasively acting intercalations, external flocking, etc. or to profile, e.g. corrugate the monofilaments in order to achieve other or additional cleaning effects which are not possible with linear or smooth-walled monofilament. These measures only have an inadequate effect in the case of a bundle due to the engagement of the bristles. This is not so with the brush having individual, standing bristles according to the invention, because here larger parts of the lateral surface act in the vicinity of the free ends during the cleaning movement.

It is finally known (EP 471 312) to shape the bristles of a bundle at the free end thereof and in particular to provide the same with a spherical thickening. The sought special effects are only inadequately obtained through the dense bristle arrangement within the bundle, whereas in the case of the brush according to the invention the free end of the individual bristle acts in an unimpeded manner, so that the shaping of the free end, e.g. by rounding, tapering or the application of a spherical thickening, can have its full effect.

Advantageously the bristles are embedded to a length on the bristle carrier which is smaller than four times the bristle diameter. Practical tests have revealed that an embedding length is sufficient which corresponds roughly to 1.5 times the bristle diameter. The embedding can take place in flowable, curing media, e.g. an adhesive or the melted-on plastic of the bristle carrier. The limited embedding length leads to the major advantage that the overall height of the bristle carrier can be very small, which is very important e.g. with toothbrushes, particularly those for children.

The spacing of the bristles is 0.5 to 4.0, particularly 1.5 to 2.0 times the bristle diameter, but the spacing is preferably smaller than the bristle diameter.

BRIEF DESCRIPTION OF THE DRAWINGS

The invention is described in greater detail hereinafter relative to non-limitative embodiments and the attached drawings, wherein show.

DETAILED DESCRIPTION

Figure 1:
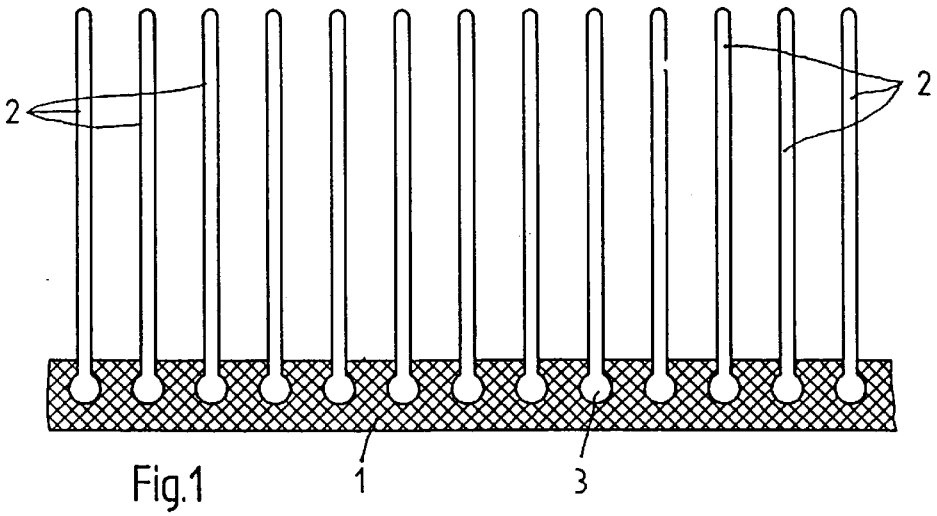
FIG. 1 A diagrammatic representation of a detail of a brush.

FIGS. 1 to 5 in each case show an e.g. plastic bristle carrier 1, as well as the individual, standing bristles 2 fastened thereto. In this embodiment each bristle 2 has at its fastening-side end a spherical or lenticular thickening 3, which is e.g. obtained by melting the bristle end. The bristles 2 are anchored by said thickened end 3 in the bristle carrier. This can take place by injecting in or round, casting in, dipping, etc. Instead of this, the bristles can also have at their fastening-side end a ridge, which is in any case formed on cutting the bristles to size, but which is normally undesired. Here it can in fact be made in a very pronounced form, so as to anchor the individual bristle.

Figure 2:
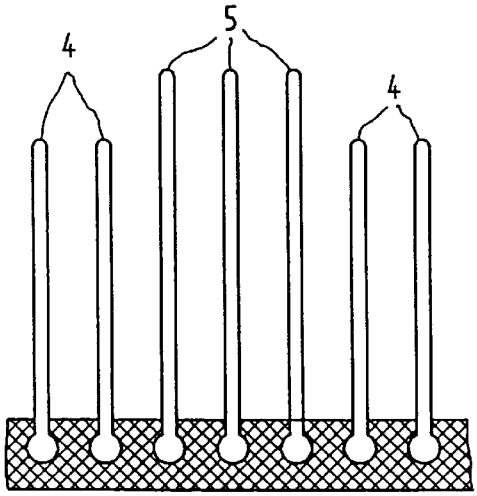
FIGS. 2 to 5 Views similar to FIG. 1 of further embodiments.

In the embodiment according to FIG. 2 the bristle facing consists of individual bristles of different length, namely shorter bristles 4 and longer bristles 5, which can optionally be arranged in groups.

Figure 3:
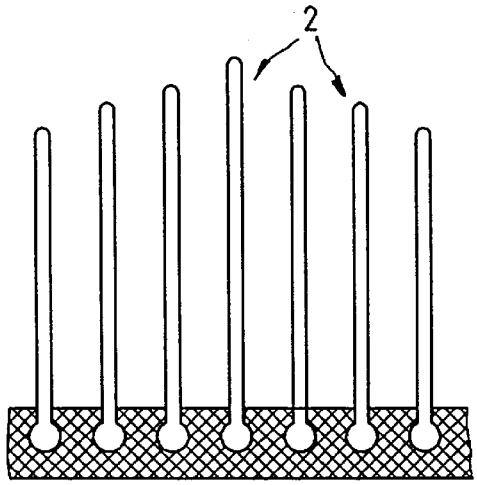

The embodiment according to FIG. 3 has on the bristle carrier 1 once again bristles 2 of varying length and which are in this case uniformly stepped.

Figure 4:
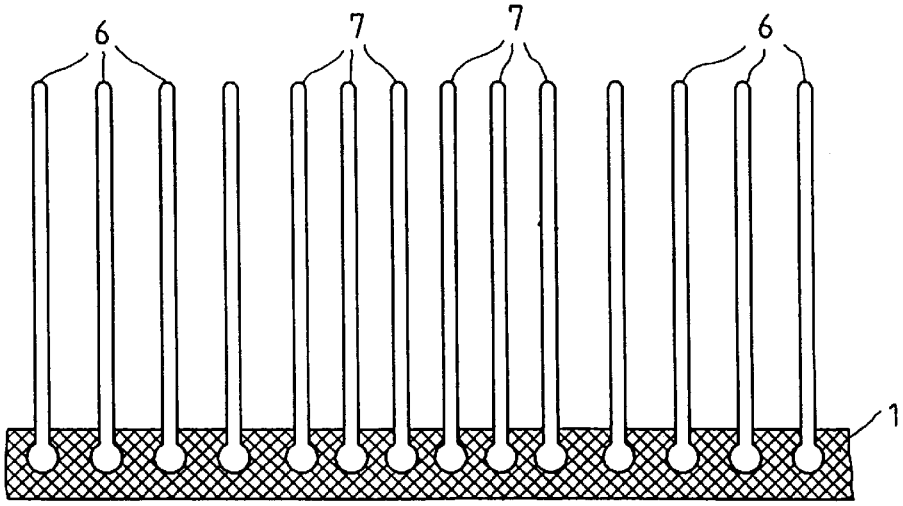

Whereas in the preceding embodiments the bristles 2 are arranged with the same spacing, FIG. 4 shows an embodiment in which the individual, standing bristles are again arranged in groups, having the same spacing within the group. Thus, the bristles 6 are given a larger spacing and the bristles 7 a smaller spacing.

Figure 5:
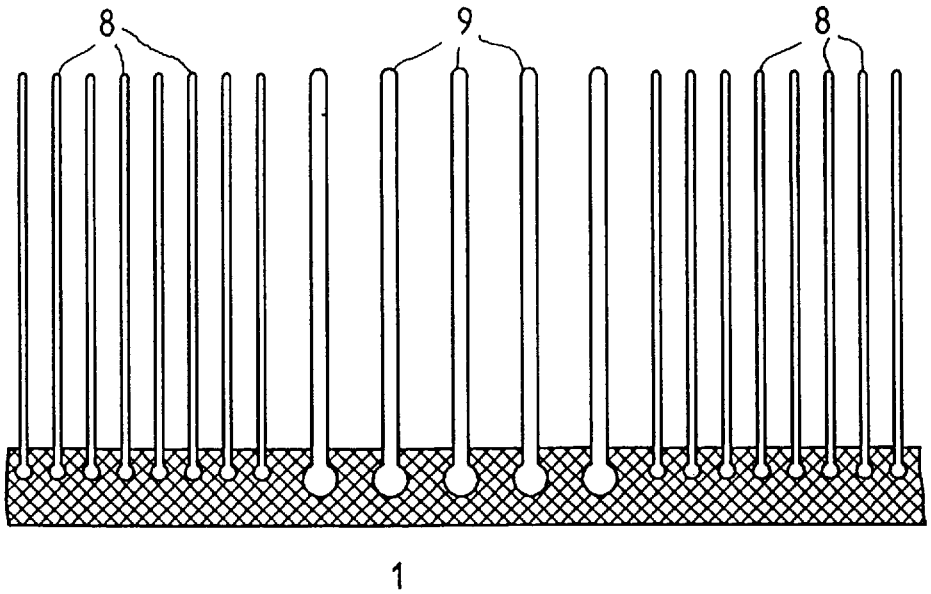

FIG. 5 shows an embodiment with bristles 8 having a smaller cross-section and bristles 9 having a larger cross-section, and in each case the thinner and thicker bristles have the same reciprocal spacing.

Figure 6:
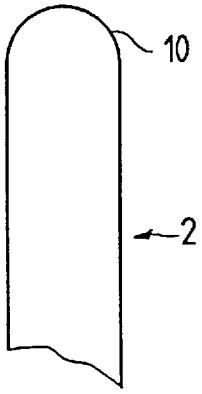
FIGS. 6 to 8 In each case a larger-scale view of an individual bristle in the vicinity of the use-side end.
Figure 7:
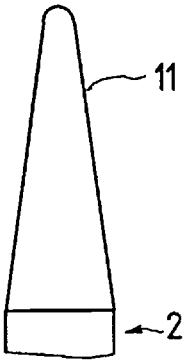
Figure 8:
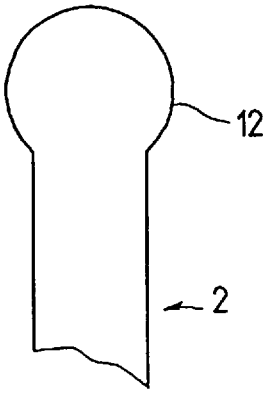

FIG. 6 shows a larger-scale fragmentary view of an individual bristle with a cylindrical cross-section and a spherically rounded tip 10, which forms the use-side end. In the embodiment according to FIG. 7 the use-side end 11 is conically shaped, whereas FIG. 8 shows a bristle 2 with a spherical thickening 12 at the use-side end. Due to the fact that the bristles are arranged in individual, standing manner it is possible, unlike in the case of a bundle arrangement, to allow the use-side end to act with its entire, contoured surface and also the lateral surface.

Figure 9:
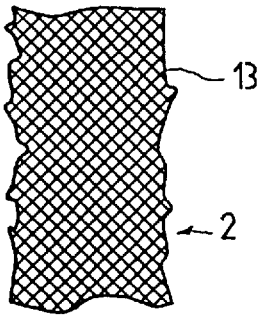
FIGS. 9 to 11 In each case a partial section through an individual bristle.
Figure 10:
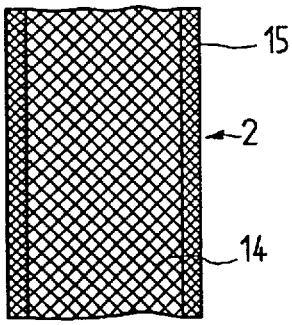
Figure 11:
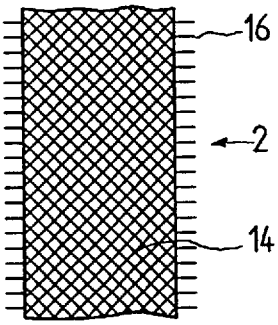

FIG. 9 shows a bristle 2 with a contoured surface 13 with optionally an abrasive action, which, due to the individual arrangement of the bristles, exerts its action over the entire length. In the embodiment according to FIG. 10 the bristle 2 comprises a shaft 14, e.g. of plastic and an e.g. abrasive coating 15. FIG. 11 shows an embodiment in which the shaft 14 of the bristle 2 is flocked with fine fibres 16.

I claim:

1. A brush, comprising a bristle carrier, and a plurality of bristles individually fastened to said bristle carrier with a spacing between adjacent bristles in the range from 0.5 to 4.0 times the bristle diameter and with the bristles embedded in the bristle carrier over a length less than four times the bristle diameter.

2. A brush according to claim 1, wherein the individual bristles have different lengths so that free ends of the bristles define a curved surface.

3. A brush according to claim 1, wherein the spacing between the adjacent bristles varies.

4. A brush according to claim 1, wherein the individual bristles are positioned in two groups and the spacing between the adjacent bristles within each group is the same, but different from the spacing between adjacent bristles within the other group.

5. A brush according to claim 1, wherein the stiffness of the bristles varies.

6. A brush according to claim 1, wherein the individual bristles are positioned in two groups and the stiffness of the bristles within each group is the same, but different from the stiffness of the bristles within the other group.

7. A brush according to claim 1, wherein at least part of the bristles are structured on their lateral surface.

8. A brush according to claim 1, wherein the bristles have rounded free ends.

9. A brush according to claim 1, wherein the bristles are embedded in the bristle carrier over a length which is approximately 1.5 times the bristle diameter.

10. A brush according to claim 1, wherein the spacing between adjacent bristles is less than the bristle diameter.

11. A brush according to claim 1, wherein the individual bristles are positioned in groups of different lengths so that free ends of the bristle groups define a stepped surface.

12. A brush according to claim 1, wherein the diameters of the bristles varies.

13. A brush according to claim 1, wherein at least part of the bristles are flocked on their lateral surface.

14. A brush according to claim 1, wherein at least part of the bristles are coated on their lateral surface.

15. A brush according to claim 1, wherein the bristles have tapered free ends.

16. A brush according to claim 1, wherein the bristles have free ends with spherical thickening.

* * * * *